United States Patent [19]

Otani

[11] Patent Number: 4,870,316

[45] Date of Patent: Sep. 26, 1989

[54] PULSED ALKALI METAL VAPOR DISCHARGE LAMP WITH CERAMICS OUTER ENVELOPE

[75] Inventor: Katsuya Otani, Kanagawa, Japan

[73] Assignee: Mitsubishi Denki Kabushiki Kaisha, Tokyo, Japan

[21] Appl. No.: 183,533

[22] Filed: Apr. 14, 1988

[30] Foreign Application Priority Data

Apr. 16, 1987 [JP] Japan ..... 62-93743
Apr. 16, 1987 [JP] Japan ..... 62-9744

[51] Int. Cl.[4] ..... H01J 17/20; H01J 61/34

[52] U.S. Cl. ..... 313/25; 313/642; 315/117

[58] Field of Search ..... 313/25, 35, 36, 44, 313/638, 639, 641, 642, 643, 572, 573; 315/117

[56] References Cited

U.S. PATENT DOCUMENTS 3,219,869 11/1965 Schmidt ..... 313/642 X
3,470,415 9/1969 Michalski ..... 315/117
4,173,728 11/1979 Witting ..... 313/163
4,418,300 11/1983 Otani et al. ..... 313/573
4,506,369 3/1985 Houston ..... 313/25 X

FOREIGN PATENT DOCUMENTS 46-18199 5/1971 Japan .

OTHER PUBLICATIONS

Campbell, "Design of Pulsed Alkali Vapor Lamps Utilizing Alumina, Yttria and Sapphire Envelopes", IES 1971 Conference.

*Primary Examiner*—Donald J. Yusko
*Assistant Examiner*—Sandra L. O'Shea
*Attorney, Agent, or Firm*—Lowe, Price, Leblanc, Becker & Shur

[57] ABSTRACT

An alkali metal vapor discharge lamp is operable in a pulsed mode. The vapor discharge lamp includes an inner envelope made of first ceramics and an outer envelope made of second ceramics for enclosing the inner envelope under a vacuum atmosphere or an innert atmosphere. The inner envelope contains cesium, mercury and a rare gas, the vapor pressure of which cesium is selected from 400 to 1000 Torr. The second ceramics of the outer envelope is selected to be alumina ceramics.

27 Claims, 7 Drawing Sheets

PULSED ALKALI METAL VAPOR DISCHARGE LAMP WITH CERAMICS OUTER ENVELOPE

BACKGROUND OF THE INVENTION

1. Field of the Invention

The present invention generally relates to a metal vapor discharge lamp. More specifically, the present invention is directed to an alkali metal vapor discharge lamp having a ceramics outer envelope operated in the pulsed mode, and to an ignition method for such an alkali metal vapor discharge lamp.

2. Description of the Related Art

A pulsed alkali metal vapor discharge lamp containing cesium is widely used as an infrared radiation lamp in a technical field such as infrared imaging utilizing infrared radiation. For instance, lamps having sapphire envelopes using cesium as a light emission metal, of a power range of several kilowatts (KW) are reviewed in a conference preprint entitled "Design of Pulsed Alkali Vapor Lamps Utilizing Alumina, Yttria and Sapphire Envelopes" presented by William R. Campbell at Illuminating Engineering Society (IES) in 1971. Such a pulsed alkali metal vapor discharge lamp normally maintains a low-power discharge (i.e., a simmer operating mode) to an extent such that the extinction of arc discharge does not occur, while discharging with a high-power pulse (i.e., a pulse operating mode) when ignition is required. Such light emission in the pulse operating mode is utilized for various applications.

FIG. 1 is a front view of the above-mentioned conventional infrared radiation lamp 100. The infrared radiation lamp 100 includes an inner envelope 1 made of ceramics, electrodes 2A and 2B formed of a tungsten coil, caps 3A and 3B mounted at opposite ends of the inner envelope 1, which caps are made of, for instance, niobium, metal conducting members 4A and 4B, external conducting members 8A and 8B, an outer envelope (jacket) 10 made of quartz, and end caps 11A and 11B for sealing opposite ends of the outer envelope 10 and connecting the metal conducting members 4A and 4B with the external conducting members 8A and 8B. The end caps are made of metal to be easily bonded to glass, such as Kovar (tradename), or Fernico (tradename). The inner envelope 1 is filled with cesium under a vapor pressure of 0.5 atm (380 Torr), mercury and rare gas. The interior of the outer envelope 10 is maintained under a vacuum, or inert atmosphere. Cesium contained in the inner envelope 1 has a resonance line at a wavelength near 850–900 nm. When discharge is conducted in the inner envelope 1, infrared radiation is realized by self-absorption of the resonance line and line spectrum of infrared.

The inner envelope 1 of another conventional infrared radiation lamp as shown in FIG. 1 is filled with cesium, mercury and rare gas. The rare gas is sealed under the pressure of normally 20 Torr, and the interior of the outer envelope 10 is maintained under a vacuum, or inert atmosphere.

In the above-mentioned conventional infrared radiation lamp 100, it has been required to increase the infrared radiation efficiency. However, the following three problems on an improvement of the infrared radiation efficiency still remain.

(1) In the conventional pulsed alkali metal vapor discharge lamp enclosing cesium, the reactivity between cesium and the inner envelope material is still indefinite.

(2) Details of the infrared radiation mechanism are not yet analyzed.

(3) Accordingly, concrete measure for increasing the infrared radiation efficiency have not been investigated, and a sufficiently high efficiency of the infrared radiation has not yet been established.

The present invention has been achieved so as to solve these conventional problems, and has a primary object of the present invention to provide a pulsed alkali metal vapor discharge lamp having a higher infrared radiation efficiency and a longer life.

Another object of the present invention is to provide an ignition method which makes easy the ignition of the above-mentioned pulsed alkali metal vapor discharge lamp and extends a life of the discharge lamp.

Still another object of the present invention is to provide a cooling system for the above-identified alkali metal vapor discharge lamp.

SUMMARY OF THE INVENTION

These objects and other features of the invention are accomplished by providing an alkali metal vapor discharge lamp (200) operable in a pulsed mode comprising:

an inner envelope (1) made of first ceramics, containing cesium, mercury and a rare gas, vapor pressure of the cesium contained in the inner envelope (1) being selected in a first pressure range; and, an outer envelope (29) made of second ceramics, enclosing the inner envelope (1) under one of a vacuum atmosphere and an inert atmosphere.

Furthermore, according to the invention, an alkali metal vapor discharge lamp (300) operable in a pulsed mode comprises:

an inner envelope (1) made of ceramics, containing cesium, mercury and a rare gas, pressure of the rare gas being selected in a second pressure range; and, an outer envelope (29) for enclosing the inner envelope (1) under one of a vacuum atmosphere and an inert atmosphere.

Moreover, according to the invention, a method for igniting an alkali metal vapor discharge lamp (200) operable in a pulsed mode, which includes:

an inner envelope (1) made of first ceramics, containing cesium, mercury and a rare gas, vapor pressure of the cesium contained in the inner envelope (1) being selected in a first pressure range; and, an outer envelope (29) made of second ceramics, enclosing the inner envelope (1) under one of a vacuum atmosphere and an inert atmosphere, comprises the following steps of:

generating a clock signal; and projecting a coolant to the outer envelope (29) of the discharge lamp (200) over a predetermined time period by counting the clock signal, before igniting the discharge lamp (200).

In addition, according to the invention, a method for igniting an alkali metal vapor discharge lamp (300) operable in a pulsed mode, which includes an inner envelope (1) made of ceramics, containing cesium, mercury and a rare gas, pressure of the rare gas being selected in a second pressure range; and, an outer envelope (29) for enclosing the inner envelope (1) under one of a vacuum atmosphere and an inert atmosphere, comprises the following steps of:

generating a clock signal, and projecting a coolant to the outer envelope (29) of the discharge lamp (300) over a predetermined time period by counting the clock signal, before igniting the discharge lamp (200).

Still, according to the invention, a cooling system for an alkali metal vapor discharge lamp (200) operable in a pulsed mode, which includes:

an inner envelope (1) made of first ceramics, containing cesium, mercury and a rare gas, vapor pressure of the cesium contained in the inner envelope (1) being selected in a first pressure range; and, an outer envelope (29) made of second ceramics, enclosing the inner envelope (1) under one of a vacuum atmosphere and an inert atmosphere, the above-described system comprises:

a timer (58) for generating a clock signal;

a coolant storage device (50) for storing a coolant; and, a control device (56) for controlling supply of the coolant to the outer envelope (29) of the discharge lamp (200) so as to cool the inner envelope (1) before igniting the discharge lamp (200) over a predetermined time period in response to the clock signal.

Further, according to the invention, a cooling system for an alkali metal vapor discharge lamp (300) operable in a pulsed mode, which includes:

an inner envelope (1) made of ceramics, containing cesium, mercury and a rare gas, pressure of the rare gas being selected in a second pressure range; and, an outer envelope (29) for enclosing the inner envelope (1) under one of a vacuum atmosphere and an inert atmosphere, the above-described system comprises:

a timer (58) for generating a clock signal;

a coolant storage device (50) for storing a coolant; and, a control device (56) for controlling supply of the coolant to the outer envelope (29) of the discharge lamp (300) so as to cool the inner envelope (1) before igniting the discharge lamp (300) over a predetermined time period in response to the clock signal.

BRIEF DESCRIPTION OF THE DRAWINGS

For a better understanding of the present invention, reference is made to the description and the accompanying drawings, in which.

DETAILED DESCRIPTION OF THE PREFERRED EMBODIMENTS

BASIC IDEAS OF THE INVENTION

Figure 1:
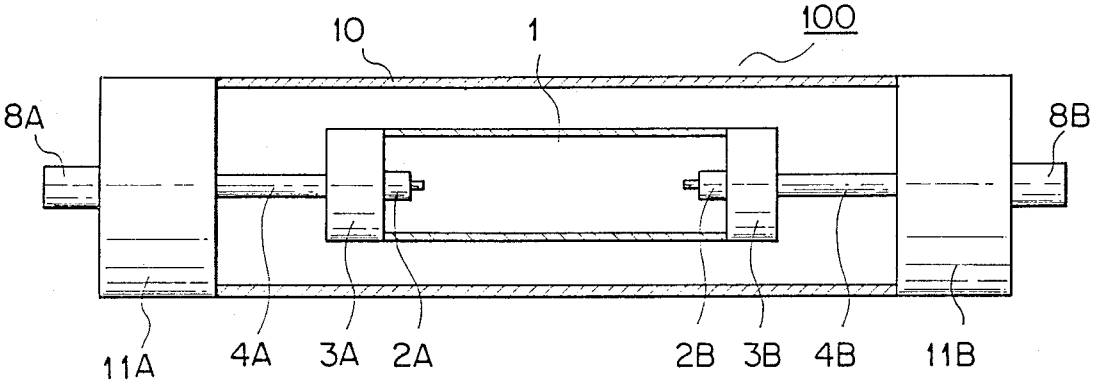
FIG. 1 is a front view of the conventional alkali metal vapor discharge lamp.

Before proceeding with various types of preferred embodiments according to the invention, basic ideas of the invention will now be described.

According to a first basic idea of the present invention, there is employed a pulsed alkali metal vapor discharge lamp having an inner envelope made of first ceramics and filled with cesium, mercury and a rare gas, and an outer envelope whose interior is maintained under vacuum or an inert atmosphere. The inner envelope is enclosed in the outer envelope. According to the first basic idea a vapor pressure of cesium contained in the inner envelope is selected to be a first pressure range of 400–1000 Torr, and the outer envelope is made of second ceramics.

In the pulsed alkali metal vapor discharge lamp according to the first basic idea, the outer envelope made of the second ceramics can transmit more the infrared radiation than that of the conventional outer envelope made of quartz. Furthermore, since the outer envelope made of the second ceramics has a high heat resistance, it can be positioned near the inner envelope to thereby increase the temperature of the inner envelope, thus increasing the infrared radiation efficiency.

According to a second basic idea of the present invention, there is provided with a pulsed alkali metal vapor discharge lamp having an inner envelope made of ceramics and filled with cesium, mercury and a rare gas. The features of this second basic idea are such that pressure of the rare gas is selected to be a second pressure range of 100–500 Torr, and the rare gas is xenon or argon.

In the pulsed alkali metal vapor discharge lamp according to the second basic idea, the pressure of the rare gas contained in the inner envelope is set to be higher than that in the conventional lamp, thereby generating the interaction between cesium and the rare gas and increasing the radiation efficiency of infrared.

According to a third basic idea of the present invention, there is employed an ignition method for a pulsed alkali metal vapor discharge lamp having an inner envelope made of first ceramics and filled with cesium, mercury and a rare gas under the pressure of 100–500 Torr, characterized in that the inner envelope is cooled for a predetermined period of time at starting of the ignition of the discharge lamp.

In the lamp ignition method according to the third basic idea, since the inner envelope is cooled at starting of the ignition of the discharge lamp, the vapor discharge lamp can be ignited at a low pulse voltage irrespective of the high pressure of the rare gas contained in the inner envelope.

According to the third basic idea of the present invention, there is further provided an ignition method for a pulsed alkali metal vapor discharge lamp having an inner envelope made of first ceramics and filled with cesium at a vapor pressure of 400–1000 Torr, mercury and a rare gas, and an outer envelope made of second ceramics and maintained under a vacuum or an inert atmosphere. The inner envelope is enclosed in the outer envelope. The feature of this basic idea is such that the inner envelope is cooled for a predetermined period of time at starting of the ignition of the discharge lamp.

PULSED ALKALI METAL VAPOR DISCHARGE LAMP WITH A CERAMICS OUTER ENVELOPE

A description will now be made of a pulsed alkali metal vapor discharge lamp 200 according to a first preferred embodiment with reference to FIGS. 2 and 3 on the basis of the first basic idea of the present invention.

Figure 2:
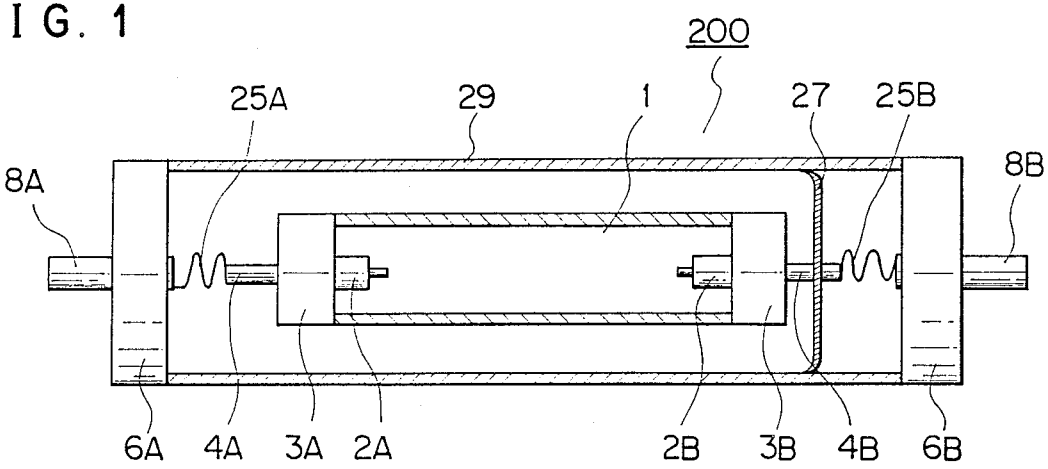
FIG. 2 is a front view of a pulsed alkali metal vapor discharge lamp according to a first preferred embodiment of the invention.
Figure 3:
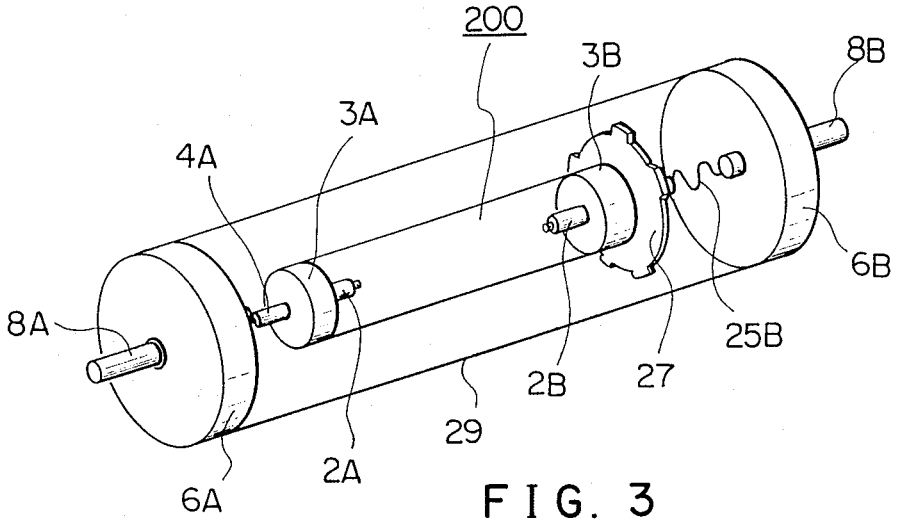
FIG. 3 is a perspective view of the lamp shown in FIG. 2.

FIG. 2 is a front view of the discharge lamp 200, and FIG. 3 is a perspective view thereof.

The same or similar parts as those in the conventional alkali metal vapor discharge lamp 100 shown in FIG. 1 are designated by the same reference numerals.

The pulsed alkali metal vapor discharge lamp 200 includes an inner envelope 1 made of first ceramics, electrodes 2A and 2B, metal caps 3A and 3B, metal conducting members 4A and 4B, and external conducting members 8A and 8B. These components are same as those shown in FIG. 1. The lamp 200 further includes metal conducting wires 25A and 25B, outer jacket (envelope) caps 6A and 6B, an envelope supporting plate 27, and an outer envelope (jacket) 29 made of alumina ceramics as second ceramics. The inner envelope 1 is filled with cesium under a vapor pressure of 400–1000 Torr, mercury and a rare gas, and the interior of the outer envelope 29 is maintained under a vacuum or an inert atmosphere. The vapor pressure of the contained gas in the inner envelope 1 is selected to be higher than that in the conventional lamp 100, as illustrated in FIG. 1.

In the first preferred embodiment, the temperature of the inner envelope 1 made of the first ceramics can be maintained substantially constant by the outer envelope 29 made of alumina ceramics, and accordingly the stable lamp characteristics can be realized.

A first different point between the discharge lamp of this embodiment and the conventional discharge lamp is that the outer envelope 29 made of alumina ceramics is replaced by the outer envelope 10 made of quartz of the conventional lamp 100 shown in FIG. 1. The employment of the outer envelope 29 made of alumina ceramics causes an increase in infrared radiation efficiency at the wavelength of 1–5 μm by about 10% as compared with the conventional lamp. This is due to the facts that the alumina ceramics have a higher infrared transmittance than that of the quartz, and have a higher heat resistance. Accordingly, the outer envelope made of alumina ceramics can be reduced in size to an extent near the size of the inner envelope from a viewpoint of lamp design, thereby reducing a radiation loss of the discharge lamp 200. As a result, the temperature of the inner envelope may be increased to thereby increase the radiation efficiency.

Figure 4:
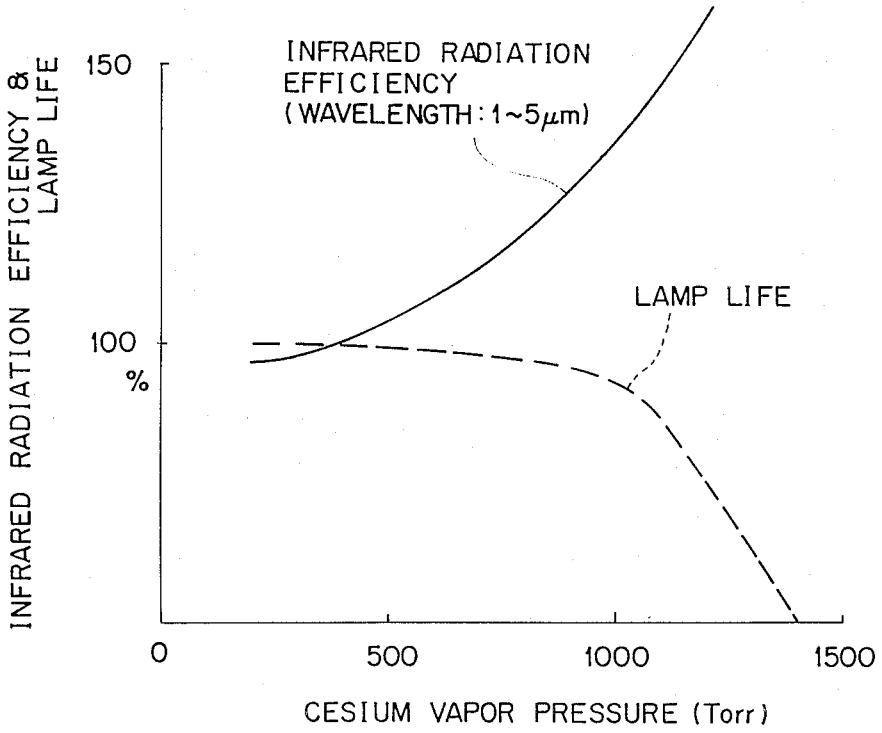
FIG. 4 is a graphic representation illustrating a relationship between the infrared radiation efficiency and cesium vapor pressure of the lamp shown in FIG. 2.

A second different point is that the cesium vapor pressure is increased up to 400–1000 Torr. FIG. 4 represents a change in infrared radiation efficiency in this embodiment under the condition that the infrared radiation efficiency at the wavelength of 1–5 μm in the conventional discharge lamp 100 with the cesium vapor pressure of 0.5 atm (380 Torr) is assumed at 100. It may be readily understood from the characteristic graph that the radiation efficiency is increased in the wavelength region of 1–5 μm with an increase in the cesium vapor pressure, because the higher the cesium vapor pressure, the higher the resonance absorption of cesium (Cs), and also a molecular spectrum of Cs-Cs influences on the increase in the infrared radiation efficiency. It was found that this efficiency increase is greater than that due to the resonance absorption of sodium. The applicant has prepared the lamps having various cesium vapor pressures, and compared the conventional lamp with an inner envelope having a cesium vapor pressure of 0.5 atm. As the result, it was found that a lamp life is rapidly reduced from the cesium vapor pressure of around 1000 Torr as shown by a dotted curved line in FIG. 4. In checking the defective lamps, it was appreciated that when the vapor pressure exceeds 1000 Torr, the temperature distribution in a radial direction becomes gentle, and the wall temperature of the ceramics inner envelope 1 is increased to generate a crack and rapidly accelerate the reaction between cesium and this ceramics, causing corrosion of the inner envelope material. Accordingly, the cesium vapor pressure may be preferably selected in the range more than 400 Torr inclusively and less than 1000 Torr inclusively (if the pressure is less than 400 Torr, the result is rendered the same as the conventional lamp). In other words, the vapor pressure of cesium is selected in the first pressure range from 400 to 1000 Torr.

Further, when sodium was contained in the inner envelope 1 in addition to cesium, mercury and a rare gas, the infrared radiation efficiency at the wavelength of 1–5 μm was increased about 5%. This may be understood that a molecular spectrum of Cs-Na is present. Therefore, the addition of sodium will be advantage in the preferred embodiment.

The rare gas to be contained in the inner envelope 1 may include any gas such as xenon, argon and neon argon as employed in the arc tube of the general metal vapor discharge lamp. The mercury to be contained in the inner envelope 1 serves to stabilize the discharging where a potential is applied across the opposite electrodes and a lamp current is reduced, and also generate a suitable temperature distribution in the radial direction. This effect is similar to that in a known high-pressure sodium lamp. The ceramics outer envelope may be made of alumina, yttria, etc., and it is preferable to use a monocrystal for the ceramics, so as to improve the directivity of light.

FIRST PULSED ALKALI METAL VAPOR DISCHARGE LAMP

Figure 5:
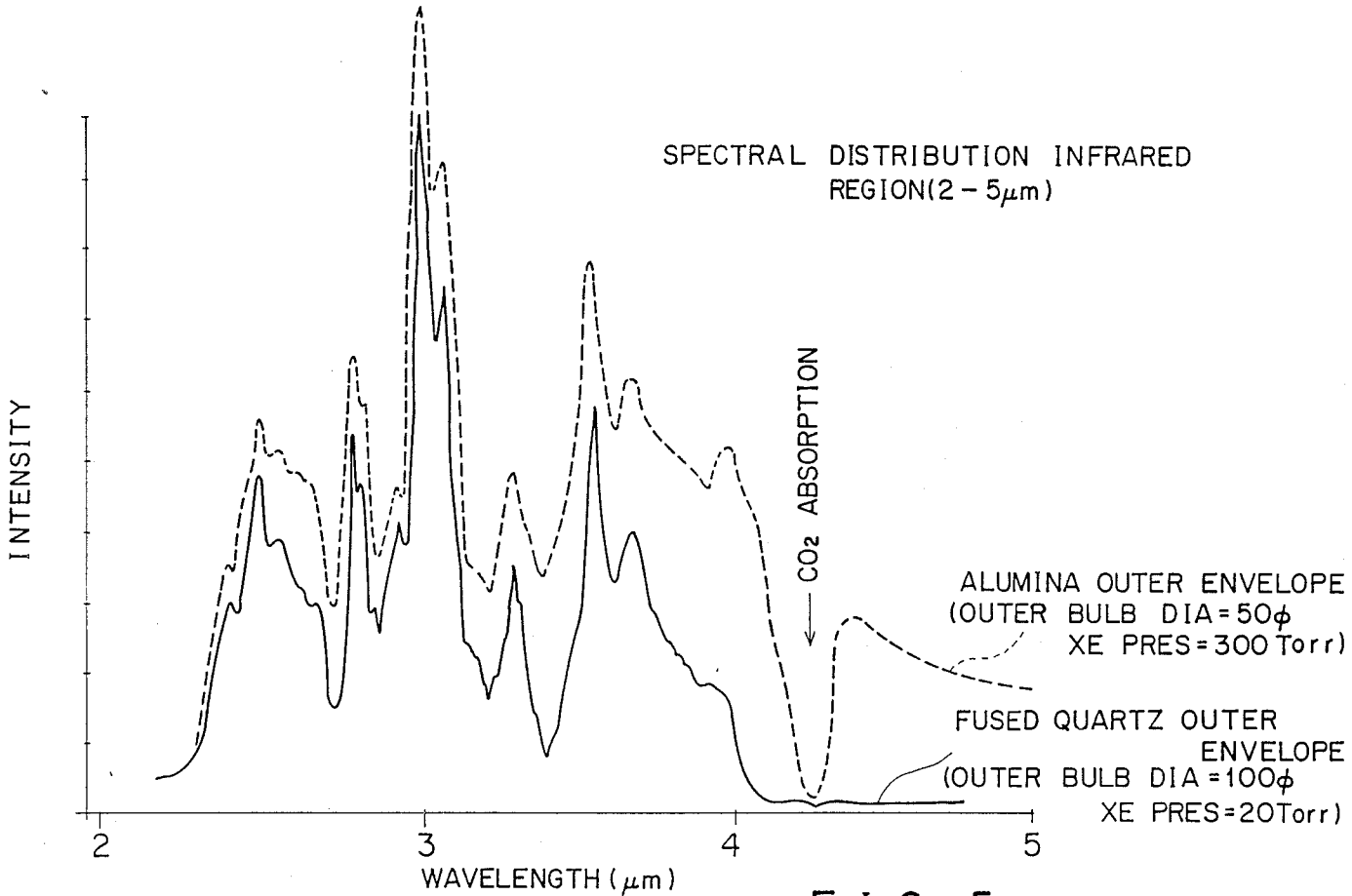
FIG. 5 is a graphic representation of the spectral distribution of the lamp manufactured based on the first basic idea of the invention.

The pulsed alkali metal vapor discharge lamp utilizing the first basic idea was tested under the following conditions to obtain an infrared spectral distribution as shown in FIG. 5.

Enclosed were cesium and mercury (Cs-Hg) in the inner envelope 1, and the alumina ceramics outer envelope 29 having an outer diameter of 50 mmϕ was employed. A xenon gas was contained in the inner envelope 1 under the pressure of 300 Torr, and the cesium vapor pressure was estimated at about 500 Torr. For the better understanding of the improvement in infrared radiation efficiency of the discharge lamp according to the preferred embodiment, there is also shown a graph of infrared radiation efficiency characteristics of the conventional pulsed alkali metal vapor discharge lamp (will be mentioned below). The conventional discharge lamp used has a quartz outer envelope having an outer diameter of 100 mmϕ and an inner envelope filled with xenon gas under the pressure of 20 Torr. The cesium vapor pressure was about 200 Torr.

As will be apparent from FIG. 5, a radiation output of the lamp using the alumina ceramics outer envelope of the preferred embodiment is greater than that of the conventional lamp using the quartz outer envelope in the infrared wavelength region of 2–4 μm. This may be understood that the average temperature of the inner envelope is increased by the alumina ceramics outer envelope to thereby increase the radiation efficiency. However, in the wavelength region of 4–5 μm, it is considered that the improvement in the radiation output will be greatly owed to the transmittance.

With the above-described test result, a substantial radiation efficiency (wavelength of 1–5 μm) of the lamp of the preferred embodiment was increased about 35% as compared with the conventional lamp mentioned above. Further, the reason why the radiation efficiency of the lamp of the preferred embodiment is high may be considered due to the fact that a molecular spectrum of Cs and Xe was increased.

PULSED ALKALI METAL VAPOR DISCHARGE LAMP EQUIPPED WITH ENVELOPE HAVING HIGH-PRESSURE RARE GAS

Figure 6:
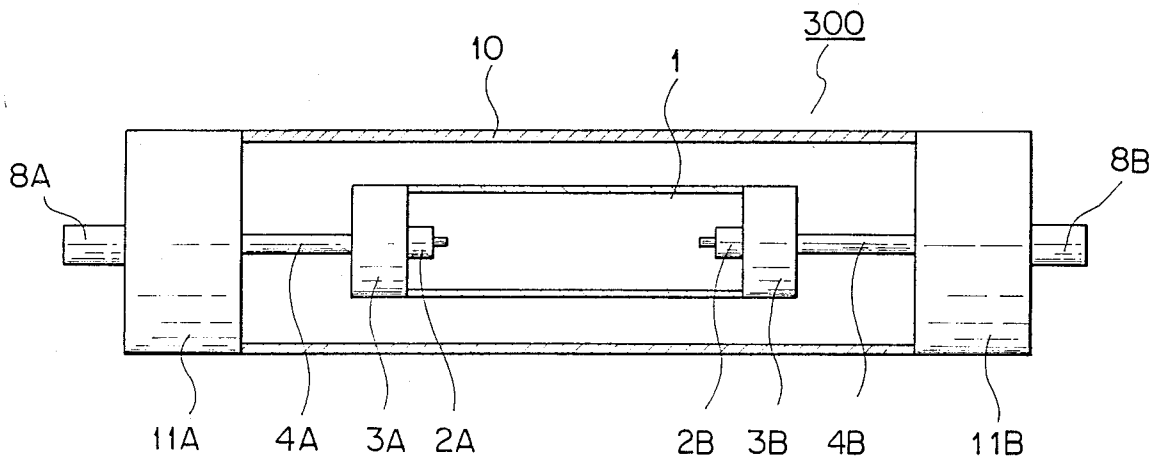
FIG. 6 is a front view of a pulsed alkali metal vapor discharge lamp according to a second preferred embodiment.

Referring now to FIG. 6, a pulsed alkali metal vapor discharge lamp 300 according to a second preferred embodiment on the basis of the second basic idea of the present invention will be described.

FIG. 6 is a front view of the discharge lamp 300, which is apparently identical with the conventional discharge lamp 100 shown in FIG. 1. Therefore, the same components as of the discharge lamp 100 are designated by the same reference numerals, and the explanation thereof will be omitted.

Figure 7:
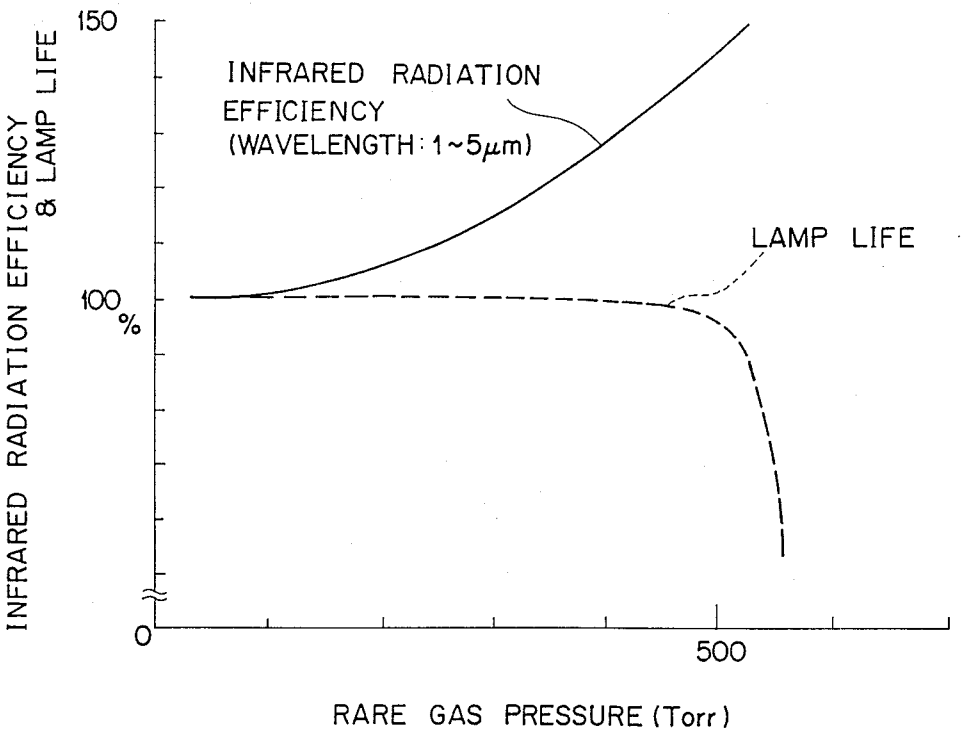
FIG. 7 is a graphic representation of the lamp characteristics shown in FIG. 6.

In the second preferred embodiment shown in FIG. 6, the applicant investigated the relationship between the infrared radiation efficiency and the lamp life by using the pulsed alkali metal vapor discharge lamp 300 shown in FIG. 6 and variously changing the rare gas pressure in the inner envelope 1, provided that the infrared radiation efficiency at the wavelength of 1–5 μm under the rare gas pressure of 20 Torr as in the conventional lamp 100 shown in FIG. 1 was assumed at 100. As a result of investigation, the relationship shown in FIG. 7 was obtained. As will be apparent from FIG. 7, as the rare gas pressure increases from 20 Torr, the infrared radiation efficiency increases. This is due to the fact that cesium and the rare gas generate a molecular spectrum. The probability of generation of the molecular spectrum may be proportional to a vapor density of the rare gas as well as a vapor density of the cesium. This effect occurs similarly in the case that xenon or argon is employed as the rare gas. Although the proportion in relative value contributing to the increase in infrared radiation efficiency was identical in both the rare gases, the proportion in absolute value was higher when xenon was used.

The lamp life was rapidly reduced under the rare gas pressure exceeding 500 Torr. This is due to the fact that a starting pulse voltage for starting the arc discharge becomes high under the pressure exceeding 500 Torr to adversely affect the inner envelope and the electrodes. Therefore, the rare gas pressure is suitably set to the second pressure range from 100–500 Torr.

IGNITION METHOD FOR ALKALI METAL VAPOR DISCHARGE LAMP

There will now be described an ignition method for the pulsed alkali metal vapor discharge lamps with reference to FIGS. 8 and 9 on the basis of the third basic idea of the present invention.

In this embodiment, the inner envelope 1 filled with a high-pressure rare gas is cooled by a liquid nitrogen or the like to substantially lower the rare gas pressure at starting, so that the discharge lamps may be started at a permissible low pulse voltage. Accordingly, the lamp life may be extended.

It should be noted that although the requirement of lowering the rare gas pressure at starting of the lamp is almost unnecessary in a discharge lamp to be ignited under normal ignition conditions, it is particularly important in the pulsed alkali metal vapor discharge lamp.

Typical examples of the cooling method according to the preferred embodiment will be now described with reference to FIGS. 8 and 9.

Figure 8:
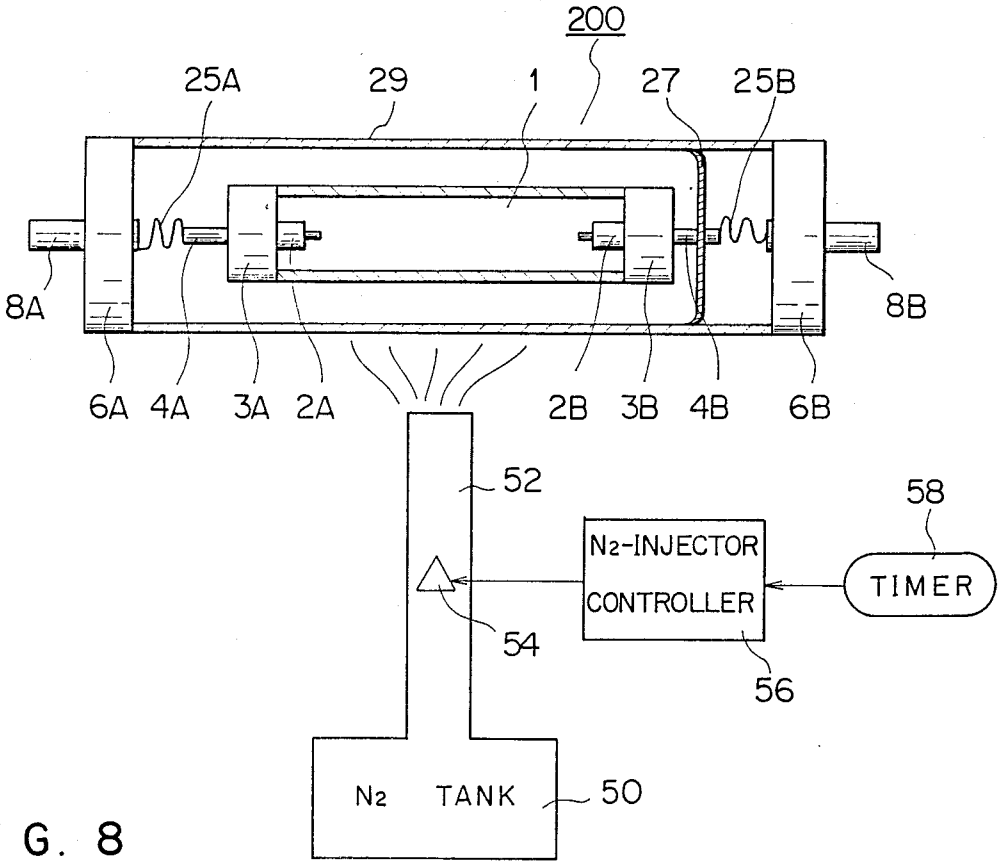
FIGS. 8 and 9 schematically illustrate the lamp cooling methods based upon the third basic idea of the invention.

FIG. 8 shows a first example applying the cooling method of the preferred embodiment to the pulsed alkali metal vapor discharge lamp 200 of the first preferred embodiment. Referring to FIG. 8, there are provided a tank 50 for storing a liquid nitrogen and an injector 54 located in an injector nozzle 52. The injector 54 is connected to an $N_2$-injector controller 56, which is in turn connected to a timer 58.

In operation, just before the pulsed alkali metal vapor discharge lamp 200 is ignited (i.e., lamp starting duration), the injector 54 is operated under control by the $N_2$-injector controller 56 to inject, or project the liquid nitrogen from the $N_2$-tank 50 through the injector nozzle 52 to the outer envelope 29 made of alumina ceramics. On the other hand, a stop clock pulse is supplied to the $N_2$-injector controller 56 after about 10 minutes by the operation of the timer 58. Then, an operation stop control signal is fed from the $N_2$-injector controller 56 to the injector 54, thus stopping the injection of the liquid nitrogen to the outer envelope 29 and completing the cooling operation before ignition of the lamp 200.

By the cooling operation, the gas pressure in the inner envelope 1 is reduced to several Torr, and a starting voltage of the lamp 200 is lowered to 1 KV or less, thereby making the ignition (lamp discharge) easy.

If the inner envelope 1 is excessively cooled, the gas contained in the inner envelope 1 is condensed to make the start of discharge difficult.

Further, the timer 58 is so designed as to change a cooling time according to the lamp output and the contained gas pressure.

Figure 9:
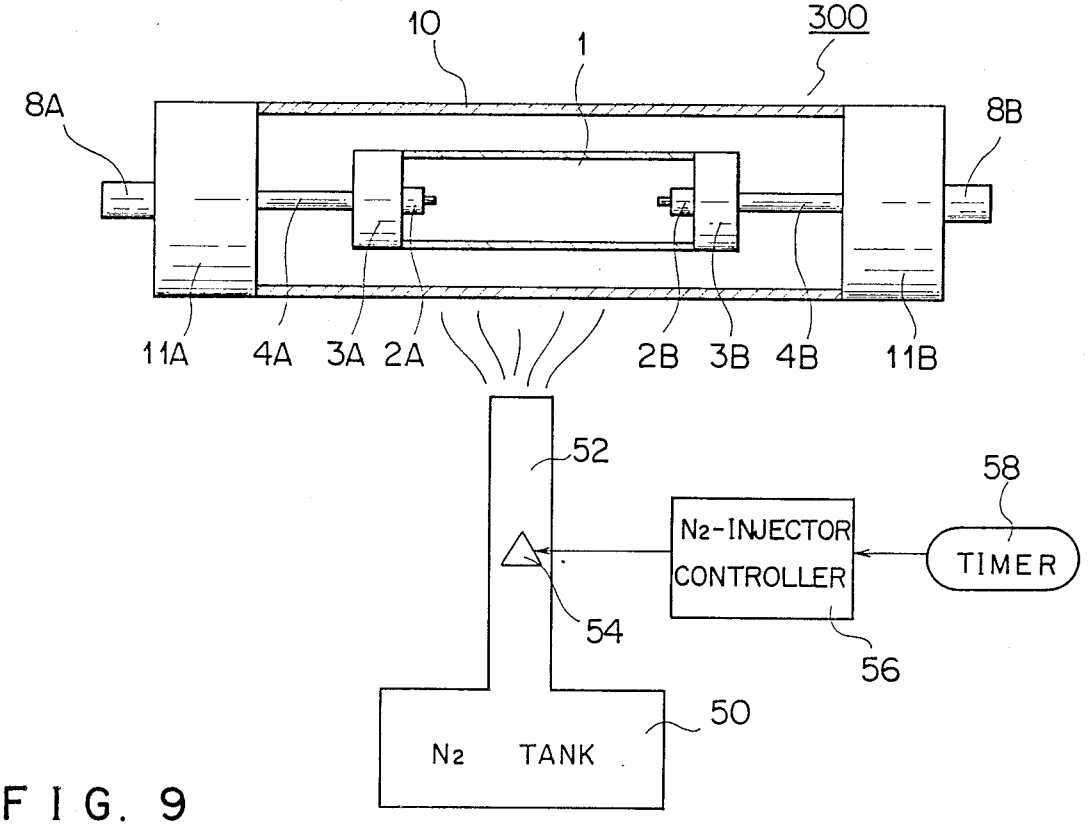

FIG. 9 shows a second example applying the cooling method of the preferred embodiment to the pulsed alkali metal vapor discharge lamp 300 of the second preferred embodiment. The construction of this second example is similar to that shown in FIG. 8, and the explanation will therefore be omitted.

SECOND PULSED ALKALI METAL VAPOR DISCHARGE LAMP

The pulsed alkali metal vapor discharge lamp according to the second basic idea was tested under the following conditions.

In the inner envelope of the Cs-Hg lamp having an inner diameter of 30 mmϕ and an arc length of 150 mm, argon was filled under the pressure of 300 Torr to prepare a pulsed alkali metal vapor discharge lamp generating an average power of 6 KW as shown in FIG. 6. As the result of a life test, the discharge lamp cleared a rated life of 300 hours, and generated an infrared radiation output increased about 10% as compared with the conventional pulsed alkali metal vapor discharge lamp using the quartz outer envelope.

THIRD PULSED ALKALI METAL VAPOR DISCHARGE LAMP

The pulsed alkali metal vapor discharge lamp according to the second basic idea was further tested under the following conditions.

In the inner envelope of the discharge lamp having an inner diameter of 20 mmϕ and an arc length of 200 mm, cesium, mercury and xenon were contained under the pressure of 300 Torr to prepare a pulsed alkali metal vapor discharge lamp generating an average power of 4 KW as shown in FIG. 6. As the result of a life test, this discharge lamp cleared a rated life and generated an infrared radiation output (wavelength of 1–5 μm) increased 15% as compared with the conventional pulsed alkali metal discharge lamp. Further, when the discharge lamp was cooled by a liquid nitrogen at starting according to the above-described cooling method, a long life increased 20% of the rated life was obtained.

As has been described above, the pulsed alkali metal vapor discharge lamp of the present invention provide the following various advantages.

As the pressure of rare gas to be enclosed in the inner envelope is set to 100–500 Torr, a life of the discharge lamp can be extended, and an infrared radiation efficiency can be also increased. Particularly, this type of the discharge lamp is effective to an infrared radiation applied field.

As the inner envelope is cooled at the starting of ignition of the pulsed alkali metal vapor discharge lamp according to the present invention, the lamp can be ignited at a low pulse voltage to thereby prolong a lamp life.

As the outer envelope is made of ceramics such as alumina and yttria, a life of the discharge lamp can be extended, and an infrared radiation efficiency can be increased. Particularly, the more effective infrared discharge lamp can be obtained in an infrared radiation applied field.

What is claimed is:

1. An alkali metal vapor discharge lamp operable in a pulsed mode comprising:

inner envelope means made of a first ceramic material and containing cesium, mercury and a rare gas, the vapor pressure of said cesium contained in said inner envelope means being in a first pressure range of 400 to 1000 Torr; and outer envelope means made of a second ceramic material and enclosing said inner envelope means under one of a vacuum atmosphere and an inert atmosphere.

2. An alkali metal vapor discharge lamp as claimed in claim 1, wherein said second ceramic material of the outer envelope means is alumina ceramic material.

3. An alkali metal vapor discharge lamp as claimed in claim 1, wherein said second ceramic material of the outer envelope means is yttria ceramic material.

4. An alkali metal vapor discharge lamp as claimed in claim 1, wherein said inner envelope means further contains sodium.

5. An alkali metal vapor discharge lamp operable in a pulsed mode comprising:

inner envelope means made for a first ceramic material and containing cesium, mercury and xenon, said cesium contained in said inner envelope means being under vapor pressure of approximately 500 Torr and said xenon contained in said inner envelope means being under a vapor pressure of approximately 300 Torr; and outer envelope means made of alumina ceramic material and enclosing said inner envelope means under one of a vacuum atmosphere and an inert atmosphere, said outer envelope means having a diameter of approximately 50 mm.

6. An alkali metal vapor discharge lamp operable in a pulsed mode comprising:

inner envelope means made of a ceramic material and containing cesium, mercury, a rare gas and sodium, the vapor pressure of said cesium being in a first pressure range of 400 to 1000 Torr and the vapor pressure of said rare gas being in a second pressure range; and outer envelope means for enclosing said inner envelope means under one of a vacuum atmosphere and an inert atmosphere.

7. An alkali metal vapor discharge lamp as claimed in claim 6, wherein said second pressure range of the rare gas is higher than 20 Torr.

8. An alkali metal vapor discharge lamp as claimed in claim 6, wherein said second pressure range of the rare gas is from 100 to 500 Torr.

9. An alkali metal vapor discharge lamp as claimed in claim 6, wherein said rare gas contains one of xenon and argon.

10. An alkali metal vapor discharge lamp as claimed in claim 6, wherein an inner diameter of said inner envelope means is selected to be approximately 30 mm, an arc length of said discharged lamp is approximately 150 mm and an argon gas is the rare gas in said inner envelope means and is under a pressure of 300 Torr.

11. An alkali metal vapor discharge lamp as claimed in claim 6, wherein a inner diameter of said inner envelope means is selected to be approximately 20 mm, an arc length of said discharge lamp is selected to be approximately 200 mm, and a xenon gas is the rare gas in said inner envelope means and is under a pressure of 300 Torr.

12. A method for cooling an alkali vapor discharge lamp operable in a pulsed mode, which discharge lamp includes:

inner envelope means made of a first ceramic material and containing cesium, mercury and rare gas, the vapor pressure of said cesium contained in said inner envelope means being in a first pressure range; and outer envelope means made of a second ceramic material and enclosing said inner envelope means under one of a vacuum atmosphere and an inert atmosphere, said method comprising the steps of:

generating a clock signal; and prior to igniting said discharge lamp, projecting a liquid nitrogen coolant to said outer envelope means of the discharge lamp over a predetermined time period by counting the clock signal.

13. A method for cooling an alkali metal vapor discharge lamp operable in a pulsed mode as claimed in claim 12, wherein said first pressure range is from 400 to 1000 Torr.

14. A method for cooling an alkali metal vapor discharge lamp operable in a pulsed mode as claimed in claim 12, wherein said second ceramic material of the outer envelope means is alumina ceramic material.

15. A method for cooling an alkali metal vapor discharge lamp operable in a pulsed mode as claimed in claim 12, wherein said second ceramic material of the outer envelope means is yttria ceramic material.

16. A method for cooling an alkali metal vapor discharge lamp operable in a pulsed mode as claimed in claim 12, wherein said inner envelope means further contains sodium.

17. A method for cooling an alkali metal vapor discharge lamp operable in a pulsed mode, which discharge lamp includes:

inner envelope means made of a first ceramic material and containing cesium, mercury and rare a gas, the vapor pressure of said cesium contained in said inner envelope means being in a first pressure range; and outer envelope means made of a second ceramic material and enclosing said inner envelope means under one of a vacuum atmosphere and an inert atmosphere, said method comprising the steps of:

generating a clock signal; and prior to igniting and discharge lamp projecting a coolant to said outer envelope means of discharge lamp over a predetermined time period by counting the clock signal.

18. A method for cooling an alkali metal vapor discharge lamp operable in a pulsed mode, which discharge lamp includes:

inner envelope means made of a ceramic material and containing cesium, mercury and rare gas, the pressure of said rare gas being in a selected pressure range; and outer envelope means for enclosing said inner envelope under one of a vacuum atmosphere and an inert atmosphere, said method comprising the steps of:

generating a clock signal; and prior to igniting said discharge lamp projecting a coolant to said outer envelope means of the discharge lamp over a predetermined time period by counting the clock signal.

19. A method for cooling an alkali metal vapor discharge lamp operable in a pulsed mode as claimed in claim 18, wherein said coolant is liquid nitrogen.

20. A method for cooling an alkali metal vapor discharge lamp operable in a pulsed mode as claimed in claim 18, wherein said selected pressure range of the rare gas is higher than 20 Torr.

21. A method for cooling an alkali metal vapor discharge lamp operable in a pulsed mode as claimed in claim 18, wherein said selected pressure range of the rare gas is from 100 to 500 Torr.

22. A method for cooling an alkali metal vapor discharge lamp operable in a pulsed mode as claimed in claim 19, wherein said rare gas contains one of xenon and argon.

23. A cooling system for an alkali metal vapor discharge lamp operable in a pulsed mode, which discharge lamp includes:

inner envelope means made of a first ceramic material and containing cesium, mercury and a rare gas, the vapor pressure of said cesium contained in said inner envelope means being in a first pressure range; and outer envelope means made of a second ceramic material and enclosing said inner envelope means under one of a vacuum atmosphere and an inert atmosphere, said cooling system comprising:

timer means for generating a clock signal;

coolant storage means for storing a coolant; and means for controlling a supply of the coolant to said outer envelope means of the discharge lamp over a predetermined time period prior to igniting the discharge lamp and in response to the clock signal.

24. A cooling system for an alkali metal vapor discharge lamp operable in a pulsed mode as claimed in claim 23, wherein said time period is set to approximately 10 minutes.

25. A cooling system for an alkali metal vapor discharge lamp operable in a pulsed mode, which discharged lamp includes:

inner envelope means made of a ceramic material containing cesium, mercury and a rare gas, the pressure of said rare gas being in a selected pressure range; and outer envelope means for enclosing said inner envelope means under one of a vacuum atmosphere and an inert atmosphere, said cooling system comprising:

timer means for generating a clock signal;

coolant storage means for storing a coolant; and means for controlling a supply of the coolant to said outer envelope means of the discharge lamp over a predetermined time period prior to igniting the discharge lamp and in response to the clock signal.

26. A cooling system for an alkali metal vapor discharge lamp operable in a pulsed mode as claimed in claim 25, wherein said time period is set to approximately 10 minutes.

27. An alkali metal vapor discharge lamp operable in a pulsed mode, comprising:

inner envelope means made of a first ceramic material and containing cesium, mercury and a rare gas, the vapor pressure of said cesium contained in said inner envelope means being in a first pressure range;

outer envelope means made of s second ceramic material and enclosing said inner envelope means under one of a vacuum atmosphere and an inert atmosphere; and a cooling system comprising:

timer means for generating a clock signal;

coolant storage means for storing a coolant; and means for controlling a supply of the coolant to said outer envelope means of the discharge lamp over a predetermined time period prior to igniting the discharge lamp and in response to the clock signal.

* * * * *